US006861025B2

(12) United States Patent
Erickson et al.

(10) Patent No.: US 6,861,025 B2
(45) Date of Patent: Mar. 1, 2005

(54) ATTENUATING FLUID MANIFOLD FOR MELTBLOWING DIE

(75) Inventors: Stanley C. Erickson, Scandia, MN (US); James C. Breister, Oakdale, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 315 days.

(21) Appl. No.: 10/177,814

(22) Filed: Jun. 20, 2002

(65) Prior Publication Data

US 2003/0234464 A1 Dec. 25, 2003

(51) Int. Cl.[7] ..... D01D 5/088; D01D 13/00; D04H 3/02

(52) U.S. Cl. ..... 264/555; 264/103; 425/72.2; 425/464

(58) Field of Search ..... 264/103, 555; 425/72.2, 464

(56) References Cited

U.S. PATENT DOCUMENTS

| | | | | |
|---|---|---|---|---|
| 3,016,599 A | | 1/1962 | Perry, Jr. | |
| 3,571,679 A | | 3/1971 | Turnhout | |
| 4,111,531 A | | 9/1978 | Lavelle et al. | |
| 4,215,682 A | | 8/1980 | Kubik et al. | |
| 4,818,463 A | * | 4/1989 | Buehning | 264/555 X |
| 4,889,476 A | | 12/1989 | Buehning | |
| 4,988,560 A | | 1/1991 | Meyer et al. | |
| 5,080,569 A | | 1/1992 | Gubernick et al. | |
| 5,098,636 A | | 3/1992 | Balk | |
| 5,236,641 A | | 8/1993 | Allen et al. | |
| 5,248,247 A | | 9/1993 | Rübhausen et al. | |
| 5,260,003 A | | 11/1993 | Nyssen et al. | |
| 5,580,581 A | | 12/1996 | Buehning | |
| 5,582,907 A | | 12/1996 | Pall | |
| 5,607,701 A | | 3/1997 | Allen et al. | |
| 5,632,938 A | | 5/1997 | Buehning, Sr. | |
| 5,667,749 A | | 9/1997 | Lau et al. | |
| 5,711,970 A | | 1/1998 | Lau et al. | |
| 5,725,812 A | | 3/1998 | Choi | |
| 5,728,407 A | | 3/1998 | Matsui | |
| 5,807,795 A | | 9/1998 | Lau et al. | |
| 5,891,482 A | | 4/1999 | Choi | |
| 5,993,943 A | | 11/1999 | Bodaghi et al. | |
| 6,001,303 A | | 12/1999 | Haynes et al. | |
| 6,057,256 A | | 5/2000 | Krueger et al. | |
| 6,182,732 B1 | | 2/2001 | Allen | |

FOREIGN PATENT DOCUMENTS

WO WO 99/46057 A1 9/1999

* cited by examiner

*Primary Examiner*—Leo B. Tentoni
(74) *Attorney, Agent, or Firm*—David R. Cleveland; Karl G. Hanson

(57) ABSTRACT

Melt blown nonwoven webs are formed by supplying attenuating fluid to a meltblowing die through an attenuating fluid distribution passage whose distribution characteristics can be changed while the die and manifold are assembled. By adjusting the distribution characteristics of the passage, the mass flow rate of attenuating fluid to channels in the meltblowing die and the temperature of the attenuating fluid at the die outlets can be made more uniform.

40 Claims, 4 Drawing Sheets

ATTENUATING FLUID MANIFOLD FOR MELTBLOWING DIE

FIELD OF THE INVENTION

This invention relates to devices and methods for preparing melt blown fibers.

BACKGROUND

Nonwoven webs typically are formed using a meltblowing process in which filaments are extruded from a series of small orifices while being attenuated into fibers using hot air or other attenuating fluid. The attenuated fibers are formed into a web on a remotely-located collector or other suitable surface.

There has been an ongoing effort to improve the uniformity of nonwoven webs. Web uniformity typically is evaluated based on factors such as basis weight, average fiber diameter, web thickness or porosity. Process variables such as material throughput, air flow rate, die to collector distance, and the like can be altered or controlled to improve nonwoven web uniformity. In addition, changes can be made in the design of the meltblowing apparatus. References describing such measures include U.S. Pat. Nos. 4,889,476, 5,236,641, 5,248,247, 5,260,003, 5,582,907, 5,728,407, 5,891,482 and 5,993,943.

The attenuating fluid typically is supplied to a manifold (e.g., an air manifold) attached to the side of the die body, optionally sent through a tortuous path in the manifold or in the die body, and then sent through attenuating fluid flow channels to exit near the filament orifices so that the attenuating fluid can impinge upon and draw down the extruded filaments into fibers. Representative manifolds, tortuous paths and flow channels are shown in, for example, U.S. Pat. Nos. 4,889,476, 5,080,569, 5,098,636, 5,248,247, 5,260,003, 5,580,581, 5,607,701, 5,632,938, 5,667,749, 5,711,970, 5,725,812, 6,001,303 and 6,182,732.

Despite many years of effort by various researchers, fabrication of commercially suitable nonwoven webs still requires careful adjustment of the process variables and meltblowing apparatus parameters, and frequently requires that trial and error runs be performed in order to obtain satisfactory results. Fabrication of wide melt blown nonwoven webs with uniform properties can be especially difficult.

SUMMARY OF THE INVENTION

Figure 1:
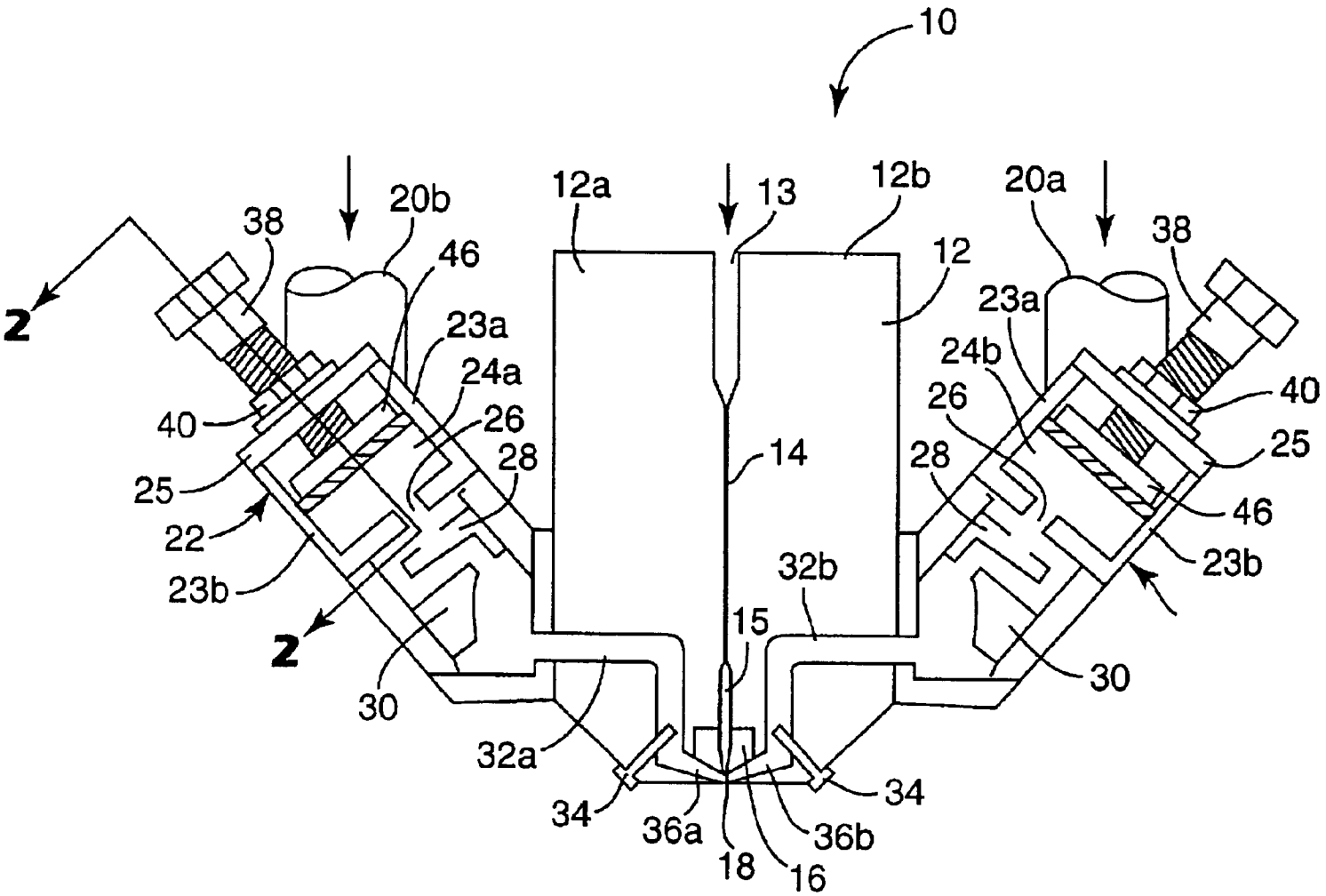
FIG. 1 is a schematic end sectional view of a meltblowing die of the invention.

Although useful, macroscopic nonwoven web properties such as basis weight, average fiber diameter, web thickness or porosity may not always provide a sufficient basis for evaluating nonwoven web quality or uniformity. These macroscopic web properties typically are determined by cutting small swatches from various portions of the web or by using sensors to monitor portions of a moving web. These approaches can be susceptible to sampling and measurement errors that may skew the results, especially if used to evaluate low basis weight or highly porous webs. In addition, although a nonwoven web may exhibit uniform measured basis weight, fiber diameter, web thickness or porosity, the web may nonetheless exhibit nonuniform performance characteristics due to differences in attenuation of the individual web fibers. A more uniform web could be obtained if each extruded filament was subjected to identical or substantially identical streams of attenuating fluid. Ideally, the attenuating fluid streams would impinge upon the filaments at an identical volumetric flow rate and temperature along the width of the die. After attenuation and collection, the resulting attenuated fibers may have more uniform physical properties from fiber to fiber and may form higher quality or more uniform melt blown nonwoven webs.

The desired fiber physical property uniformity preferably is evaluated by determining one or more intrinsic physical or chemical properties of the collected fibers, e.g., their weight average or number average molecular weight, and more preferably their molecular weight distribution. Molecular weight distribution can conveniently be characterized in terms of polydispersity. By measuring properties of fibers rather than of web swatches, sampling errors are reduced and a more accurate measurement of web quality or uniformity can be obtained.

The present invention provides, in one aspect, a meltblowing apparatus comprising:

a) a meltblowing die having (i) a plurality of filament outlets and (ii) a plurality of attenuating fluid flow channels in fluid communication with a plurality of attenuating fluid outlets exiting the die near the filament outlets;

b) a manifold in fluid communication with a plurality of the channels, the manifold having at least one inlet for attenuating fluid; and c) an attenuating fluid distribution passage between a manifold inlet and corresponding attenuating fluid outlets, wherein the distribution characteristics of the passage can be changed while the die and manifold are assembled in order to make the attenuating fluid temperature in the channels more uniform.

In another aspect, the invention provides a method for forming a fibrous web comprising:

a) flowing fiber-forming material through a meltblowing die having (i) a plurality of filament outlets and (ii) a plurality of attenuating fluid flow channels in fluid communication with a plurality of attenuating fluid outlets exiting the die near the filament outlets;

b) flowing attenuating fluid through at least one inlet in a manifold in fluid communication with a plurality of the channels; and c) changing the distribution characteristics of an attenuating fluid distribution passage between the manifold inlet and corresponding attenuating fluid outlets while the die and manifold are assembled to order to make the attenuating fluid temperature in the channels more uniform.

The devices and methods of the invention can provide higher quality or more uniform melt blown nonwoven webs, including webs having more uniform physical properties from fiber to fiber. The devices and methods of the invention can be adjusted to provide uniform delivery of attenuating fluid to a meltblowing die over a variety of attenuating fluid flow rates and meltblowing die operating conditions. Preferred embodiments of the invention permit adjustment during meltblowing.

DETAILED DESCRIPTION

As used in this specification, the phrase "nonwoven web" refers to a fibrous web characterized by entanglement, and preferably having sufficient coherency and strength to be self-supporting.

The term "meltblowing" means a method for forming a nonwoven web by extruding a fiber-forming material through a plurality of orifices to form filaments while contacting the filaments with air or other fluid to attenuate the filaments into fibers and thereafter collecting a layer of the attenuated fibers.

The phrase "meltblowing temperatures" refers to the meltblowing die temperatures at which meltblowing typically is performed. Depending on the application, meltblowing temperatures can be as high as 315° C., 325° C. or even 340° C. or more.

The phrase "meltblowing die" refers to a die for use in meltblowing.

The term "passage" refers to an enclosed space in a meltblowing die or attenuating fluid manifold through which attenuating fluid flow can occur.

The phrase "distribution passage" refers to a passage in a meltblowing die or attenuating fluid manifold that communicates with a plurality of attenuating fluid outlets and that can affect the respective mass flow rates of attenuating fluid through such outlets.

The phrase "distribution characteristics" refers to the relative mass flow rates of attenuating fluid through a plurality of attenuating fluid outlets.

The phrase "changed while the die and manifold are assembled" refers to an alteration in the distribution characteristics of a distribution passage that is implemented while a manifold is fastened to a meltblowing die. This phrase does not exclude the possible temporary removal of other parts such as heat shields, insulation, access covers and the like from the die or manifold in order to carry out the adjustment.

The phrase "melt blown fibers" refers to fibers made using meltblowing. The aspect ratio (ratio of length to diameter) of melt blown fibers is essentially infinite (e.g., generally at least about 10,000 or more), though melt blown fibers have been reported to be discontinuous. The fibers are long and entangled sufficiently that it is usually impossible to remove one complete melt blown fiber from a mass of such fibers or to trace one melt blown fiber from beginning to end.

The phrase "attenuate the filaments into fibers" refers to the conversion of a segment of a filament into a segment of greater length and smaller diameter.

The term "polydispersity" refers to the weight average molecular weight of a polymer divided by the number average molecular weight of the polymer, with both weight average and number average molecular weight being evaluated using gel permeation chromatography and a polystyrene standard.

The phrase "fibers having substantially uniform polydispersity" refers to melt blown fibers whose polydispersity differs from the average fiber polydispersity by less than ±5%.

Figure 2:
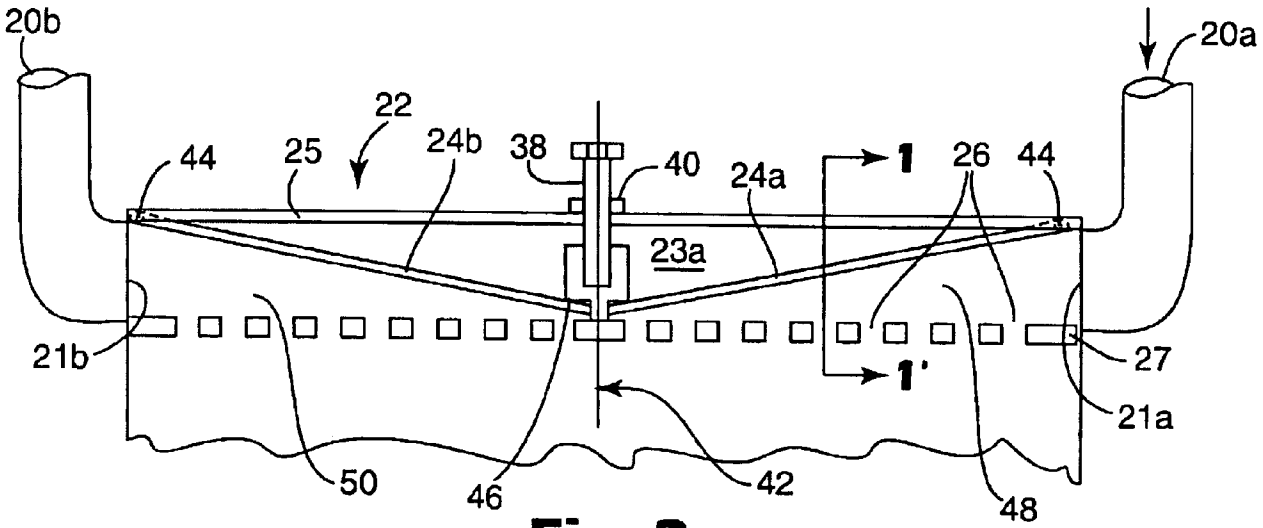
FIG. 2 is a schematic side view of an adjustable air manifold for use in the meltblowing die of FIG. 1.

FIG. 1 is a schematic end sectional view of a meltblowing apparatus 10 of the invention taken through line 1–1' in FIG. 2. FIG. 2 is a partial side sectional view of a portion of apparatus 10 taken through line 2–2' in FIG. 1. Referring to FIG. 1 and FIG. 2, meltblowing apparatus 10 includes meltblowing die 12 formed from two die body halves 12*a* and 12*b*. Fiber-forming material (e.g., a thermoplastic polymer) enters meltblowing die 12 through inlet 13, travels through passages 14, 15 and removable tip 16, and exits die 12 via a plurality of filament outlets (such as outlet 18) closely-spaced along the width of die 12.

Attenuating fluid (typically heated air) travels through conduits 20*a* and 20*b* and enters inlets 21*a* and 21*b* at either end of the manifolds 22. Each manifold 22 extends along the width of die 12 and has a midline 42 that corresponds generally to the midpoint of die 12. After passing through inlets 21*a* and 21*b*, the attenuating fluid is deflected by movable top wall 24*a* and 24*b* into a series of small orifices 26 spaced along manifold lower wall 27. The attenuating fluid next travels through a tortuous path past dams 28 and 30 and enters a plurality of attenuating fluid channels (such as channels 32*a* and 32*b*) spaced along the width of die 12. The attenuating fluid in some of the channels flows past a thermocouple such as thermocouple 34 and exits meltblowing die 12 through a plurality of attenuating fluid outlets (such as attenuating fluid outlets 36*a* and 36*b*) spaced along the width of die 12 near tip 16.

In the absence of movable top walls 24*a* and 24*b* and other possible influencing factors such as adjustable heat input devices that might be embedded in die 12, the attenuating fluid in manifold 22 would vary in temperature and pressure along the length of manifold 22. Because attenuating fluid will be extracted from manifold 22 at each orifice 26 (and assuming that walls 24*a* and 24*b* were not present), the attenuating fluid in manifold 22 would have a higher temperature and higher pressure proximate inlet ends 21*a* and 21*b*, and a lower temperature and lower pressure proximate midline 42. This temperature and pressure differential would cause a corresponding differential in the mass flow rates of attenuating fluid through the orifices 26, with a greater mass flow rate occurring proximate inlet ends 21*a* and 21*b* and a lower mass flow rate occurring proximate midline 42. Assuming that a constant pressure drop subsequently arises between the orifices 26 and the attenuating fluid outlets such as outlets 36*a* and 36*b*, the temperature of the attenuating fluid in the attenuating fluid channels (such as channels 32*a* and 32*b*) and at the attenuating fluid outlets (such as outlets 36*a* and 36*b*) would vary along the width of die 12 and a nonuniform nonwoven web would be produced.

Movable top walls 24*a* and 24*b* and adjusting bolt 38 preferably can be used to compensate for such temperature and pressure variation, preferably can provide for more uniform delivery of attenuating fluid to channels 32*a* and 32*b*, and preferably can permit adjustment, reduction or possible elimination of attenuating fluid mass flow rate and temperature differentials at the attenuating fluid outlets. Movable top walls 24*a* and 24*b* are fastened at their outboard ends via hinges 44 to manifold 22. At the adjustment position shown in FIG. 2, the inboard ends of top walls 24*a* and 24*b* nearly meet one another near midline 42. Inlet 21*a*, top wall 24*a*, bottom wall 27 and sidewalls 23*a* and 24*a* of manifold 22 generally define a shaped passage 48 that helps to equalize the mass flow rate through orifices 26 of the attenuating fluid from supply conduit 20*a*. The cross-sectional area of passage 48 is greatest proximate inlet 21*a* and at a minimum proximate midline 42. This reduced cross-sectional area proximate midline 42 offsets the decrease in attenuating fluid pressure and temperature that otherwise might occur due to extraction of attenuating fluid through orifices 26 as the attenuating fluid travels toward midline 42. Likewise, inlet 21*b*, top wall 24*b*, bottom wall 27 and sidewalls 23*a* and 23*b* of manifold 22 generally define another shaped passage 50 that helps to equalize the mass flow rate through orifices 26 of the attenuating fluid from supply conduit 20*b*.

By moving bolt 38 in or out of manifold 22, the distribution characteristics of passages 48 and 50 can be adjusted in order to make the attenuating fluid mass flow rates and temperatures in the channels of die 12 more uniform. Bolt 38 passes through a threaded opening in fixed top wall 25 of manifold 22, and is held in place by locknut 40. The lower end of bolt 38 is free to rotate in an unthreaded hole in elongate rubbing block 46. The lower end of block 46 bears against the inboard ends of top walls 24*a* and 24*b*. The fluid pressure (e.g., air pressure) of the attenuating fluid entering manifold 22 will hold the inboard ends of walls 24*a* and 24*b* firmly against the lower surface of rubbing block 46. As bolt 38 is threaded in or out of manifold 22, the distribution characteristics of passages 48 and 50 will change. For a given attenuating fluid volumetric flow rate into manifold 22, an appropriate setting for bolt 38 and a corresponding shape for passages 48 and 50 usually can be found to provide uniformly distributed mass flow rates of the attenuating fluid along the length of manifold 22 and uniform attenuating fluid temperatures at the attenuating fluid outlets. Attainment of the desired passage distribution characteristics can be verified by monitoring the attenuating fluid temperature in several of the fluid flow channels such as channel 32*a* and channel 32*b* using a plurality of thermocouples 34 distributed along the width of die 12.

Further details regarding the manner in which meltblowing would be carried out with such an apparatus can be found, for example, in the patents cited above and in Wente, Van A., "Superfine Thermoplastic Fibers" in Industrial Engineering Chemistry, Vol. 48, p. 1342 et seq. (1956), or in Report No. 4364 of the Naval Research Laboratories, published May 25, 1954, entitled "Manufacture of Superfine Organic Fibers," by Wente, V. A.; Boone, C, D.; and Fluharty, E. L.

Figure 3:
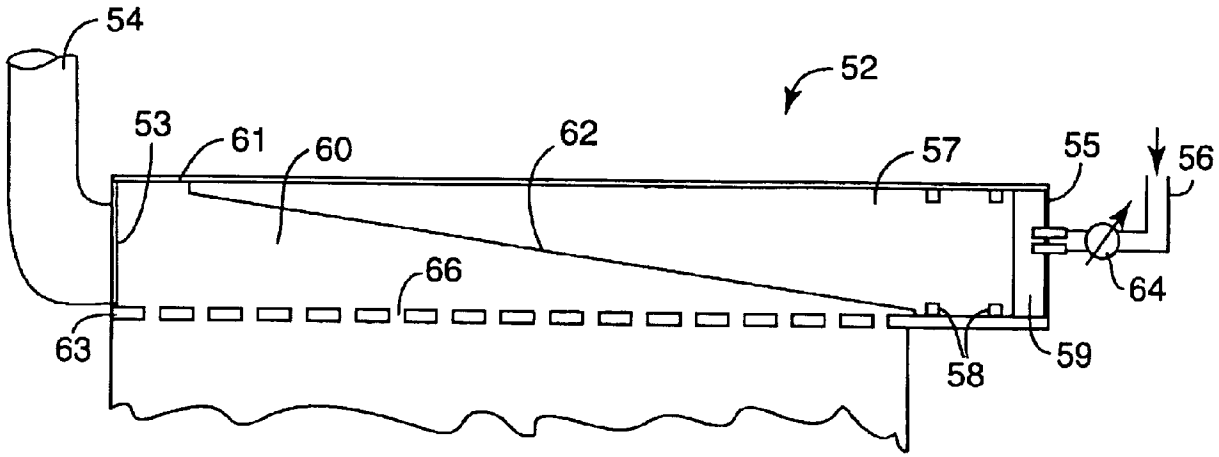
FIG. 3 is a schematic side view of another adjustable air manifold for use in the meltblowing die of FIG. 1.

FIG. 3 is a schematic side view of another adjustable air manifold 52 for use in a meltblowing die such as that shown in FIG. 1. Manifold 52 has a single inlet 53 supplied with attenuating fluid from conduit 54. The closed end 55 of manifold 52 is supplied with compressed air via conduit 56. A sliding wedge-shaped piston 57 equipped with sealing rings 58 will move towards inlet 53 when the air pressure in space 59 exceeds the attenuating fluid pressure in shaped passage 60, and will move towards closed end 55 when the attenuating fluid pressure in shaped passage 60 exceeds the air pressure in space 59. When the respective pressures are equal, piston 57 will occupy an equilibrium position within manifold 52. The distribution characteristics of passage 60 are generally defined by inlet 53, manifold fixed top wall 61, inclined piston face 62, manifold lower wall 63 and the sidewalls of manifold 52. By adjusting air pressure regulator 64, the position of piston 57 and thus the distribution characteristics of passage 60 can be changed to provide uniformly distributed mass flow rates of the attenuating fluid through the orifices 66 spaced along the length of manifold 52, and uniform attenuating fluid temperatures at the attenuating fluid outlets of die 12.

Figure 4:
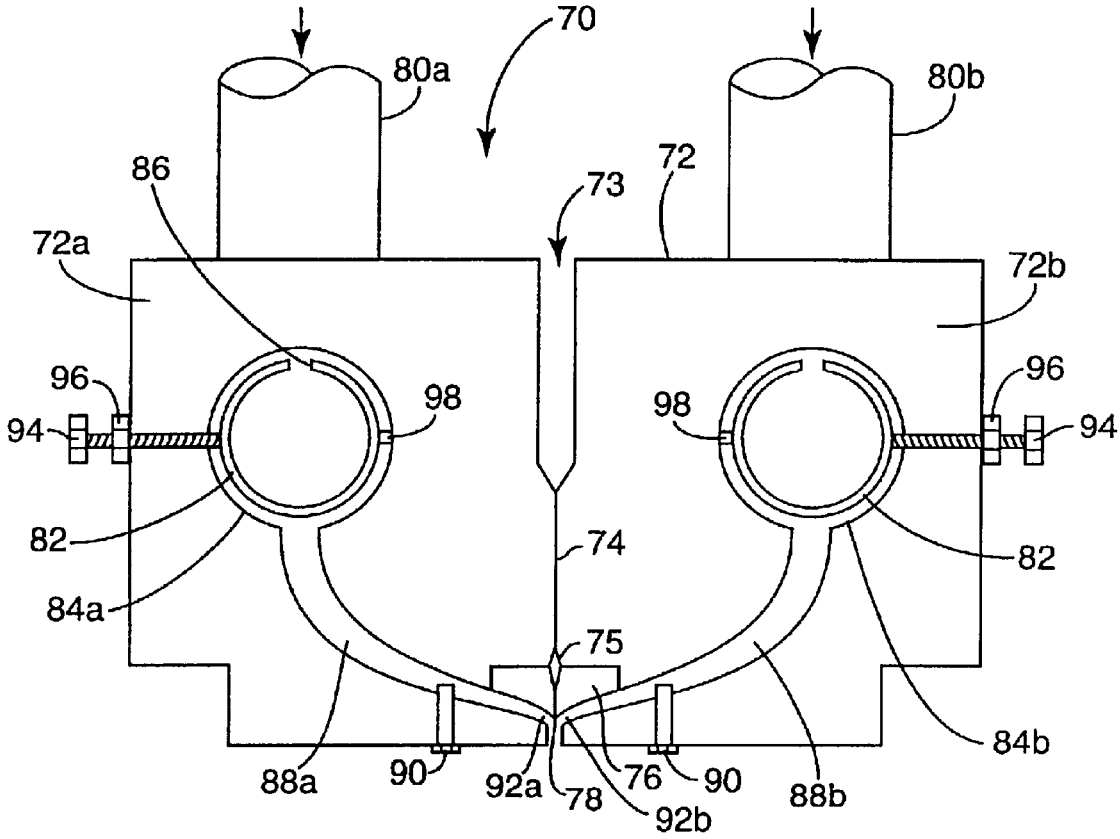
FIG. 4 is a schematic end sectional view of another meltblowing die of the invention.

FIG. 4 is a schematic end sectional view of a meltblowing apparatus 70 of the invention. Apparatus 70 includes meltblowing die 72 formed from two die body halves 72*a* and 72*b*. Fiber-forming material enters meltblowing die 72 through inlet 73, travels through passages 74, 75 and removable tip 76, and exits die 72 via a plurality of filament outlets (such as outlet 78) closely-spaced along the width of die 72.

Figure 5:
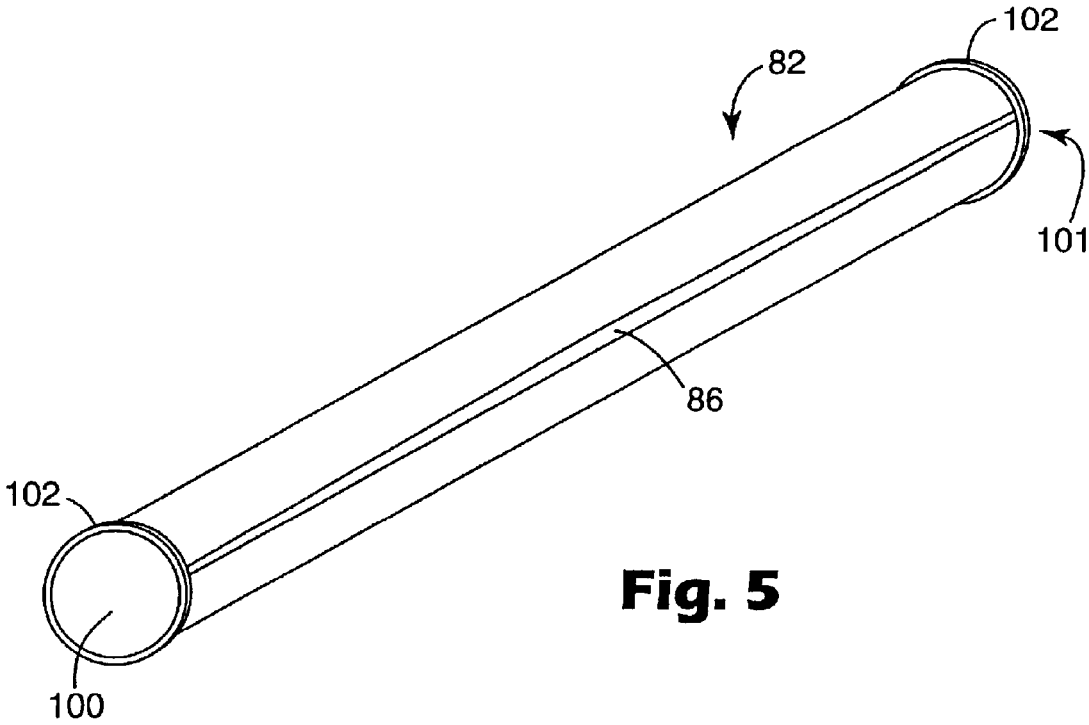
FIG. 5 is a schematic perspective view of an adjustable air manifold for use in the meltblowing die of FIG. 4.

Referring to FIG. 4 and FIG. 5, attenuating fluid travels through conduits such as conduits 80*a* and 80*b* and enters inlets 100 and 101 at the ends of the tubular spring steel manifolds 82. Mounting rings 102 center manifolds 82 within cylindrical chambers 84*a* and 84*b* bored in die body halves 72*a* and 72*b*. Manifolds 82 extend along the entire width of die 72. The attenuating fluid exits each manifold 82 through a passage in the form of a tapered slot 86 whose distribution characteristics can be changed by adjusting threaded bolts 94 in or out of die 12. Locknuts 96 hold bolt 94 in place. Stops 98 bear against the inboard side of each manifold 82. As the bolts 94 are tightened, passage 86 narrows near the midline of manifold 82 (and the shape and distribution characteristics of passage 86 change) due to inward deflection of the manifold sidewalls. When the bolts 94 are loosened, passage 86 widens and its shape returns generally to its original configuration.

The passage 86 shown in FIG. 5 typically will not require a large opening or a severe degree of taper. As an example, when two 38 mm diameter manifolds 82 are used on a 1.2 meter wide meltblowing die, the passage 86 preferably ranges from about 0.6–2 mm in width proximate the inlet end of the manifold to about 1.8–3.5 mm in width proximate the midline of the manifold, more preferably from about 1.3–1.8 mm in width proximate the inlet end of the manifold to about 2.1–2.8 mm in width proximate the midline of the manifold. Often a suitable range of adjustment can be obtained by changing a dimension of the passage by one mm or less. A variety of adjustment mechanisms can be used to alter the distribution characteristics of the passage. As representative alternatives to the clamping bolt 94 shown in FIG. 4, a wedge could be driven into or retracted out of the passage 86 near the midline of manifold 82, a clamp could be wrapped around at least a portion of manifold 82, or a threaded drawbolt whose ends are equipped with right and left hand threads could be attached to the sidewalls of manifold 82 and used to draw the sidewalls together or force them apart.

Figure 6:
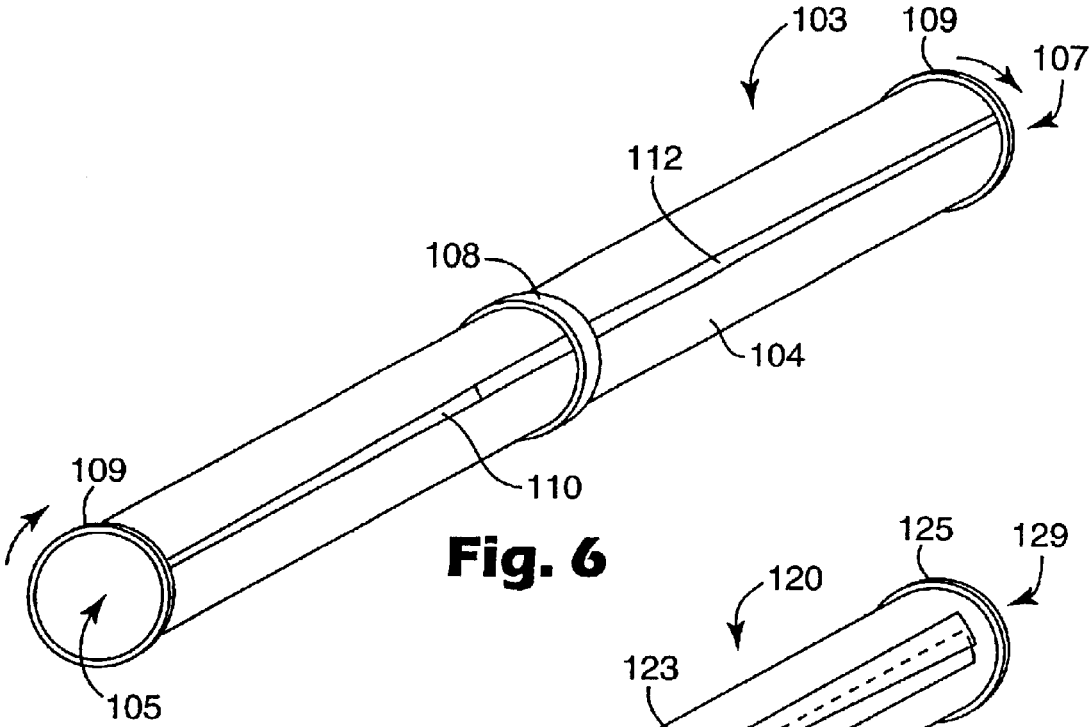
FIG. 6 is a schematic perspective view of another adjustable air manifold for use in the meltblowing die of FIG. 4.

FIG. 6 shows another manifold that could be used in a meltblowing die such as is shown in FIG. 4. Manifold 103 has a generally tubular body portion 104 having end inlets 105 and 107. Body portion 104 is supported by fixed central ring 108 and rotatable end rings 109. Tapered slots 110 and 112 form a passage whose flow characteristics can be adjusted by rotating the rings 109 while holding ring 108 stationary, thereby twisting the ends of body portion 104 and changing the end to end taper of the slots 110 and 112. A relatively modest amount of twist can produce a fairly substantial change in airflow characteristics.

Figure 7:
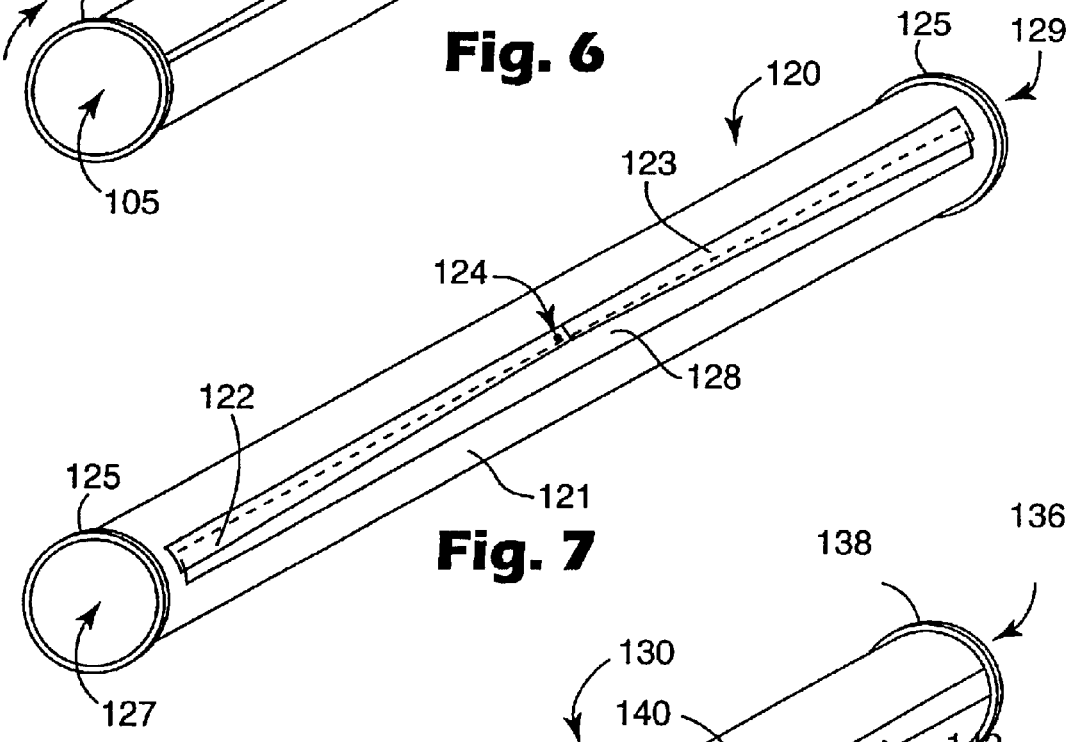
FIG. 7 is a schematic perspective view of another adjustable air manifold for use in the meltblowing die of FIG. 4.

FIG. 7 shows an exploded view of another manifold that could be used in a meltblowing die such as is shown in FIG. 4. Manifold 120 has a generally tubular body portion 121 having end inlets 127 and 129. Body portion 121 is supported by end rings 125. A pair of movable shutters 122 and 123 partly cover aperture 128. Shutters 122 and 123 pivot about hinge point 124. The distribution characteristics of manifold 120 can be adjusted by moving shutters 122 and 123 around hinge point 124, thereby changing the end to end taper of the exposed portion of aperture 128.

Figure 8:
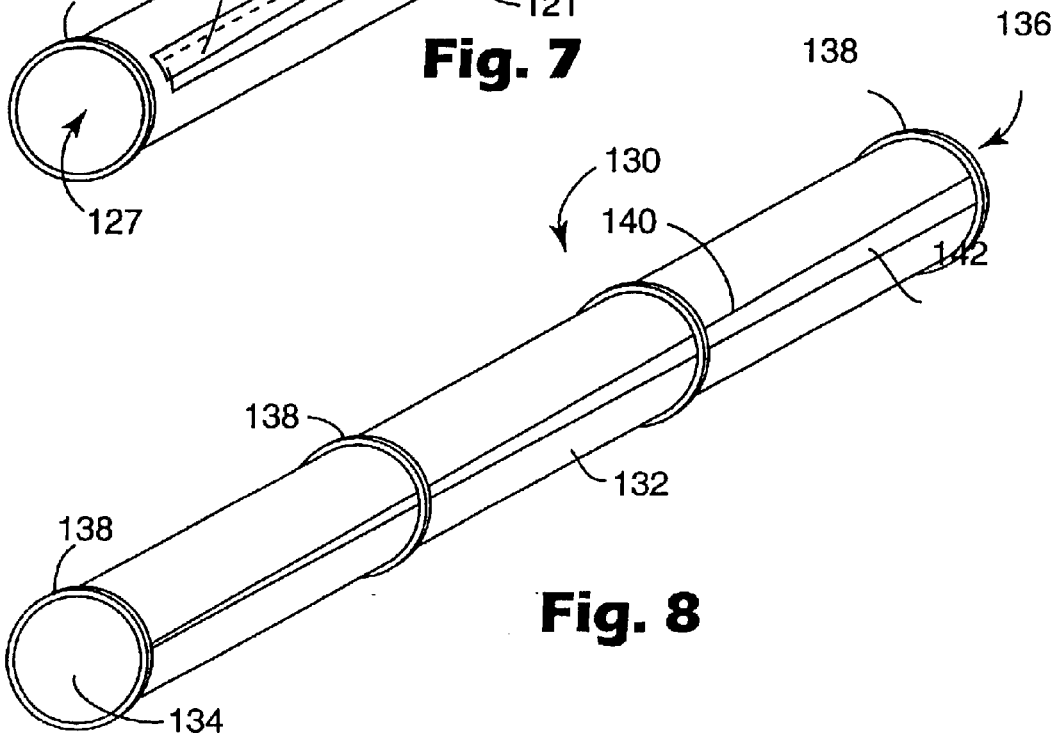
FIG. 8 is a schematic perspective view of another adjustable air manifold for use in the meltblowing die of FIG. 4.

FIG. 8 shows another manifold that could be used in a meltblowing die such as is shown in FIG. 4. Manifold 130 is formed from a single tube 132 having a single inlet end 134 and a closed end 136. Standoff rings 114 hold the sidewalls of tube 132 away from bores 84*a* and 84*b*. Tapered slot 140 forms a passage 142 whose distribution characteristics can be adjusted by sliding tube 132 into or out of bore 84*a* or 84*b*.

Those skilled in the art will recognize that attenuating fluid distribution passages having a variety of shapes and sizes can be employed in the present invention, and that a variety of adjustment mechanisms or techniques can be used to adjust the distribution characteristics of such passages. When air is used as the attenuating fluid, the passage preferably can accommodate volumetric air flow rates between about 20 and about 100 liters/minute/cm of passage length. Thus a meltblowing die having two parallel attenuating fluid manifolds preferably can accommodate volumetric air flow rates between about 40 and about 200 liters/minute/cm of die width. Preferably the adjustment can maintain the attenuating fluid temperature in the channels to ±5° C. along the width of the die, more preferably to ±3° C. Preferably the adjustment can be performed using simple mechanical tools and with minimal removal of heat shields, insulation or other components of the meltblowing die. More preferably, the adjustment can be performed during meltblowing. If desired, the adjustment can be automated using suitable sensors and controls and an appropriate feedback mechanism, e.g., to monitor die conditions or web characteristics.

Those skilled in the art will also appreciate that the meltblowing dies of the invention can include additional (e.g., secondary) attenuating fluid streams that operate in concert with one or more primary attenuating fluid streams to carry out meltblowing. For example, the meltblowing dies of the invention can include one or more secondary air passages whose distribution characteristics can be adjusted as described above.

Particularly preferred meltblowing die cavities for use in the meltblowing dies of the present invention are shown in copending application Ser. No. 10/177,446 entitled "NONWOVEN WEB DIE AND NONWOVEN WEBS MADE THEREWITH", filed Jun. 20, 2002, the disclosure of which is incorporated herein by reference. Preferably an array of such die cavities are arranged to form a wider or thicker web than could be obtained using a single die cavity.

Preferably, fiber-forming material is applied to the meltblowing dies of the present invention using a planetary gear metering pump such as shown in copending application Ser. No. 10/177,419 entitled "MELTBLOWING APPARATUS EMPLOYING PLANETARY GEAR METERING PUMP", filed Jun. 20, 2002, the disclosure of which is incorporated herein by reference.

Those skilled in the art will appreciate that the meltblowing die does not need to be planar. A meltblowing apparatus of the invention can employ an annular die having a central axis of symmetry, for forming a cylindrical array of filaments. A die having a plurality of nonplanar (curved) die cavities can also be arranged around the circumference of a cylinder to form a larger diameter cylindrical array of filaments than would be obtained using only a single annular die cavity of similar die depth. A plurality of nested annular nonwoven dies of the invention can also be arranged around a central axis of symmetry to form a multilayered cylindrical array of filaments.

Preferred meltblowing systems of the invention may be operated using a flat temperature profile, with reduced reliance on adjustable heat input devices (e.g., electrical heaters mounted in the die body) or other compensatory measures to obtain uniform output. This may reduce thermally generated stresses within the die body and may discourage die cavity deflections that could cause localized basis weight nonuniformity. Heat input devices may be added to the dies of the invention if desired. Insulation may also be added to assist in controlling thermal behavior during operation of the die.

Preferred meltblowing systems of the invention can produce highly uniform webs. If evaluated using a series (e.g., 3 to 10) of 0.01 $m^2$ samples cut from the near the ends and middle of a web (and sufficiently far away from the edges to avoid edge effects), preferred meltblowing systems of the invention may provide nonwoven webs having basis weight uniformities of ±2% or better, or even ±1% or better. Using similarly-collected samples, preferred meltblowing systems of the invention may provide nonwoven webs comprising at least one layer of melt blown fibers whose polydispersity differs from the average fiber polydispersity by less than ±5%, more preferably by less than ±3%.

A variety of synthetic or natural fiber-forming materials may be made into nonwoven webs using the meltblowing systems of the invention. Preferred synthetic materials include polyethylene, polypropylene, polybutylene, polystyrene, polyethylene terephthalate, polybutylene terephthalate, linear polyamides such as nylon 6 or nylon 11, polyurethane, poly(4-methyl pentene-1), and mixtures or combinations thereof. Preferred natural materials include bitumen or pitch (e.g., for making carbon fibers). The fiber-forming material can be in molten form or carried in a suitable solvent. Reactive monomers can also be employed in the invention, and reacted with one another as they pass to or through the die. The nonwoven webs may contain a mixture of fibers in a single layer (made for example, using two closely spaced die cavities sharing a common die tip), a plurality of layers (made for example, using a plurality of die cavities arranged in a stack), or one or more layers of multicomponent fibers (such as those described in U.S. Pat. No. 6,057,256).

The fibers in nonwoven webs made using the meltblowing systems of the invention may have a variety of diameters. For example, the fibers may be ultrafine fibers averaging less than 5 or even less than 1 micrometer in diameter; microfibers averaging less than about 10 micrometers in diameter; or larger fibers averaging 25 micrometers or more in diameter.

The nonwoven webs made using the meltblowing systems of the invention may contain additional fibrous or particulate materials as described in, e.g., U.S. Pat. Nos. 3,016,599, 3,971,373 and 4,111,531. Other adjuvants such as dyes, pigments, fillers, abrasive particles, light stabilizers, fire retardants, absorbents, medicaments, etc., may also be added to the nonwoven webs. The addition of such adjuvants may be carried out by introducing them into the fiber-forming material stream, spraying them on the fibers as they are formed or after the nonwoven web has been collected, by padding, and using other techniques that will be familiar to those skilled in the art. For example, fiber finishes may be sprayed onto the nonwoven webs to improve hand and feel properties.

The completed nonwoven webs may vary widely in thickness. For most uses, webs having a thickness between about 0.05 and 15 centimeters are preferred. For some applications, two or more separately or concurrently formed nonwoven webs may be assembled as one thicker sheet product. For example, a laminate of spun bond, melt blown and spun bond fiber layers (such as the layers described in U.S. Pat. No. 6,182,732) can be assembled in an SMS configuration. Nonwoven webs may also be prepared using the meltblowing systems of the invention by depositing the stream of fibers onto another sheet material such as a porous nonwoven web that will form part of the completed web. Other structures, such as impermeable films, may be laminated to the nonwoven webs through mechanical engagement, heat bonding, or adhesives.

The nonwoven webs may be further processed after collection, e.g., by compacting through heat and pressure to cause point bonding, to control sheet caliper, to give the web a pattern or to increase the retention of particulate materials. The nonwoven webs may be electrically charged to enhance their filtration capabilities as by introducing charges into the fibers as they are formed, in the manner described in U.S. Pat. No. 4,215,682, or by charging the web after formation in the manner described in U.S. Pat. No. 3,571,679.

The nonwoven webs made using the meltblowing systems of the invention may have a wide variety of uses, including filtration media and filtration devices, medical fabrics, sanitary products, oil adsorbents, apparel fabrics, thermal or acoustical insulation, battery separators and capacitor insulation.

Various modifications and alterations of this invention will be apparent to those skilled in the art without departing from the scope and spirit of this invention. This invention should not be restricted to that which has been set forth herein only for illustrative purposes.

What is claimed is:

1. A meltblowing apparatus comprising:

a) a meltblowing die having (i) a plurality of filament outlets and (ii) a plurality of attenuating fluid flow channels in fluid communication with a plurality of attenuating fluid outlets exiting the die near the filament outlets;

b) a manifold in fluid communication with a plurality of the channels, the manifold having at least one inlet for attenuating fluid; and c) an attenuating fluid distribution passage between a manifold inlet and corresponding attenuating fluid outlets, wherein the distribution characteristics of the passage can be changed while the die and manifold are assembled in order to make the attenuating fluid temperature in the channels more uniform.

2. An apparatus according to claim 1 wherein the distribution characteristics can be changed to provide substantially equal attenuating fluid temperatures in the channels.

3. An apparatus according to claim 1 wherein the distribution characteristics can be changed to provide substantially equal attenuating fluid temperatures at the attenuating fluid outlets.

4. An apparatus according to claim 1 wherein the distribution characteristics can be changed while the die is in operation.

5. An apparatus according to claim 1 wherein the die has a width, the manifold has a midline, and the manifold extends along the die width between first and second attenuating fluid inlets in the manifold.

6. An apparatus according to claim 5 wherein the passage comprises a region of the manifold between the first and second inlets in which the cross-sectional area of the manifold is greater proximate the inlets than proximate the midline.

7. An apparatus according to claim 5 wherein the passage comprises an elongate fluid opening extending along the die width and the volumetric flow of attenuating fluid through the opening is greater proximate the midline than proximate the inlets.

8. An apparatus according to claim 1 wherein the die has a width and the manifold extends along the die width between a first end having an attenuating fluid inlet and a second end that is closed.

9. An apparatus according to claim 8 wherein the passage comprises a region of the manifold between the first and second ends in which the cross-sectional area of the manifold is greater proximate the first end than proximate the second end.

10. An apparatus according to claim 8 wherein the passage comprises an elongate attenuating fluid opening extending along the die width and the volumetric flow of attenuating fluid through the opening is greater proximate the second end than proximate the first end.

11. An apparatus according to claim 1 wherein the die has a width and the passage comprises a conduit extending along the die width and having a sidewall with a tapered slot therein.

12. An apparatus according to claim 11 wherein the mass flow of attenuating fluid through the passage can be changed by varying the width of the slot.

13. An apparatus according to claim 12 wherein the width of the slot can be varied using a device that deflects the conduit sidewall.

14. An apparatus according to claim 13 wherein the device comprises a clamp.

15. An apparatus according to claim 13 wherein the device comprises a wedge.

16. An apparatus according to claim 1 wherein the distribution characteristics can be changed using hydraulic pressure.

17. An apparatus according to claim 1 wherein the distribution characteristics can be changed using a movable shutter.

18. An apparatus according to claim 1 wherein the distribution characteristics can be changed using a movable passage wall.

19. An apparatus according to claim 1 wherein a dimension of the passage can be changed over a range of about 1 mm.

20. An apparatus according to claim 1 wherein the attenuating fluid is air and the distribution characteristics can be changed to accommodate volumetric air flow rates between about 20 and about 100 liters/minute/cm of passage length while maintaining the attenuating fluid temperature in the channels to within about ±5° C. along the width of the die.

21. A method for forming a fibrous web comprising:

a) flowing fiber-forming material through a meltblowing die having (i) a plurality of filament outlets and (ii) a plurality of attenuating fluid flow channels in fluid communication with a plurality of attenuating fluid outlets exiting the die near the filament outlets;

b) flowing attenuating fluid through at least one inlet in a manifold in fluid communication with a plurality of the channels; and c) changing the distribution characteristics of an attenuating fluid distribution passage between the manifold inlet and corresponding attenuating fluid outlets while the die and manifold are assembled to order to make the attenuating fluid temperature in the channels more uniform.

22. A method according to claim 21 comprising changing the distribution characteristics to provide substantially equal attenuating fluid temperatures in the channels.

23. A method according to claim 21 comprising changing the distribution characteristics to provide substantially equal attenuating fluid temperatures at the attenuating fluid outlets.

24. A method according to claim 21 comprising changing the distribution characteristics while meltblowing.

25. A method according to claim 21 wherein the die has a width, the manifold has a midline and the manifold extends along the die width between first and second attenuating fluid inlets in the manifold.

26. A method according to claim 25 wherein the passage comprises a region of the manifold between the first and second inlets in which the cross-sectional area of the manifold is greater proximate the inlets than proximate the midline.

27. A method according to claim 25 wherein the passage comprises an elongate fluid opening extending along the die width and the volumetric flow of attenuating fluid through the opening is greater proximate the midline than proximate the inlets.

28. A method according to claim 21 wherein the die has a width and the manifold extends along the die width between a first end having an attenuating fluid inlet and a second end that is closed.

29. A method according to claim 28 wherein the passage comprises a region of the manifold between the first and second ends in which the cross-sectional area of the manifold is greater proximate the first end than proximate the second end.

30. A method according to claim 28 wherein the passage comprises an elongate attenuating fluid opening extending along the die width and the volumetric flow of attenuating fluid through the opening is greater proximate the second end than proximate the first end.

31. A method according to claim 21 wherein the die has a width and the passage comprises a conduit extending along the die width and having a sidewall with a tapered slot therein.

32. A method according to claim 21 comprising changing the volumetric flow of attenuating fluid through the passage by varying the width of the slot.

33. A method according to claim 32 wherein the width of the slot is varied using a device that deflects the conduit sidewall.

34. A method according to claim 33 wherein the device comprises a clamp.

35. A method according to claim 33 wherein the device comprises a wedge.

36. A method according to claim 21 comprising changing the distribution characteristics using hydraulic pressure.

37. A method according to claim 21 comprising changing the distribution characteristics using a movable shutter.

38. A method according to claim 21 comprising changing the distribution characteristics using a movable passage wall.

39. A method according to claim 21 wherein a dimension of the passage can be varied over a range of about 1 mm.

40. A method according to claim 21 wherein the attenuating fluid is air and the distribution characteristics can be changed to accommodate volumetric air flow rates between about 20 and about 100 liters/minute/cm of passage length while maintaining the attenuating fluid temperature in the channels to within about ±5° C. along the width of the die.

* * * * *